US007594515B2

(12) United States Patent
Prock

(10) Patent No.: US 7,594,515 B2
(45) Date of Patent: Sep. 29, 2009

(54) SURVEILLANCE SHIELD AND METHOD

(76) Inventor: Steven J. Prock, 7745 178th St., Chippewa Falls, WI (US) 54729

( * ) Notice: Subject to any disclaimer, the term of this patent is extended or adjusted under 35 U.S.C. 154(b) by 396 days.

(21) Appl. No.: 11/181,112

(22) Filed: Jul. 14, 2005

(65) Prior Publication Data

US 2007/0149051 A1 Jun. 28, 2007

(51) Int. Cl.
*E04H 15/58* (2006.01)

(52) U.S. Cl. ..... 135/117; 135/115; 135/901; 160/135; 43/1; 89/36.01

(58) Field of Classification Search ..... 135/115, 135/117, 901; 160/135, 351; 89/36.01, 36.05–36.07, 89/36.14, 36.5; 109/49.5; 359/838, 847, 359/871; 43/1
See application file for complete search history.

(56) References Cited

U.S. PATENT DOCUMENTS

| | | | | | |
|---|---|---|---|---|---|
| 1,895,197 | A | * | 1/1933 | Martinson | 2/2.5 |
| 3,745,938 | A | | 7/1973 | Hathaway et al. | |
| 4,245,546 | A | | 1/1981 | Chaires | |
| 4,674,394 | A | * | 6/1987 | Martino | 89/36.05 |
| 4,817,579 | A | * | 4/1989 | Mathias | 124/23.1 |
| 4,974,575 | A | * | 12/1990 | Mitchell | 124/88 |
| 5,142,833 | A | * | 9/1992 | Svehaug | 52/71 |
| 5,172,525 | A | * | 12/1992 | Cook | 52/71 |
| 5,293,807 | A | * | 3/1994 | Hajdu | 89/36.07 |
| 5,373,863 | A | | 12/1994 | Prizio | |
| 5,554,816 | A | | 9/1996 | Skaggs et al. | |
| 5,592,960 | A | | 1/1997 | Williams | |
| 5,675,926 | A | * | 10/1997 | Manka | 43/1 |
| 6,164,005 | A | * | 12/2000 | Copeland | 43/1 |
| 6,296,005 | B1 | * | 10/2001 | Williams et al. | 135/98 |
| 6,408,865 | B1 | * | 6/2002 | Bliss | 135/118 |

(Continued)

FOREIGN PATENT DOCUMENTS

DE 4207811 A1 * 9/1993

(Continued)

OTHER PUBLICATIONS

Stealthhunting Technologies, "Mirored Hunting Blind & Stands," four printed pages of http://www.stealthhunting.com/ web site, including photos and text, prior to Jun./2005.

(Continued)

*Primary Examiner*—Winnie Yip
(74) *Attorney, Agent, or Firm*—Anthony J. Bourget

(57) ABSTRACT

A surveillance shield comprising a rigid, substantially inflexible mirrored plastic panel, and at least one aperture defined by the panel, the aperture positioned in the panel such that a user may peer through the aperture while carrying the shield. The shield may also include a second mirrored plastic panel, each of the plastic panels having a frame member connected at an edge portion of the panels, the panels detachably connected to each other in a vertical attitude, each of the panels having a substantially optically correct outward facing surface to reflect accurately the surrounding environment and thereby substantially conceal the appearance of the shield. Preferably the aperture is positioned such that a user is substantially concealed by the shield while the user carries the shield and simultaneously peers through the shield to observe game, people or a target.

27 Claims, 7 Drawing Sheets

U.S. PATENT DOCUMENTS

| | | | | |
|---|---|---|---|---|
| 6,622,607 | B1 * | 9/2003 | Miller | 89/36.07 |
| 6,807,890 | B1 * | 10/2004 | Fuqua | 89/36.02 |
| 6,899,009 | B2 | 5/2005 | Christiansen et al. | |
| 6,925,745 | B1 * | 8/2005 | Alessi | 43/1 |
| 7,100,626 | B2 * | 9/2006 | Livacich | 135/90 |
| 7,121,290 | B2 * | 10/2006 | Eastman, II | 135/121 |
| 7,124,675 | B1 * | 10/2006 | Sand | 89/36.07 |
| 7,216,644 | B2 * | 5/2007 | Haugen | 124/86 |
| 7,275,532 | B2 * | 10/2007 | Niemackl et al. | 124/86 |
| 2007/0006909 | A1 * | 1/2007 | Lewis | 135/115 |

FOREIGN PATENT DOCUMENTS

| | | | |
|---|---|---|---|
| GB | 2122732 A | * | 1/1984 |
| JP | 2000039297 A | * | 2/2000 |

OTHER PUBLICATIONS

Stalker Shield, "Stalker Shield," single page of http://www.sportclimbers.com/stalkerindex.htm web page, including photos and text, published Aug. 25, 1999, USA.

Stalker Shield Instructions, "Stalker Shield," two pages of http://www.sportclimbers.com/ssinstructions.htm web page, including photos and text, published Oct. 22, 2000,USA.

Mike Slinkard, Shielding for Antelope, http://www.sportclimbers.com/antelope.htm, published on Oct. 22, 2000, three pages; USA.

Ex. Stephen M. Johnson, International Search Report—Mailed Aug. 27, 2008, PCT/US07/04409, Filed Feb. 20, 2007.

Ex. Stephen M. Johnson, Written Opinion of the International Searching Authority—Mailed Aug. 27, 2008, PCT/US07/04409, Filed Feb. 20, 2007.

* cited by examiner

SURVEILLANCE SHIELD AND METHOD

CROSS-REFERENCE TO RELATED APPLICATIONS, IF ANY

None.

BACKGROUND

1. Technical Field

This invention relates to shields for surveilling and more specifically to light-weight portable reflective shields for surveillance of people, game and/or targets.

2. Description of the Related Art

The ability to secretly approach a target without detection or to otherwise operate surveillance of prey without being noticed has long been a desire of hunters, soldiers, spies, and law enforcement authorities for ages. It is not uncommon to use shields as protective devices in combat or for sneaking up on prey. Typical hunting or combat shields, however, are generally readily visible to the combatant or prey. With a typical shield it is often difficult to sneak up on a target since the shield is visible and draws attention. Other common camouflage attempts for use in surveillance or stalking include use of specially colored clothing, face paints, or props to simulate the surrounding or background environment to lessen the chances of detection. The particulars of the environment, however, change from place to place and therefore typical camouflage clothing and props lack the flexibility desired for ease of use from place to place.

There are some examples of the use of mirror technology in hunting applications, such as in creating stationary hunting blinds for placement in the woods. Examples of such hunting blinds include those as shown in U.S. Pat. No. 5,592,960, and U.S. Pat. No. 5,373,863. With such blinds, the hunter positions himself behind a mirror or wall of mirrors so the game does not readily distinguish the hunter, instead viewing the reflection of the terrain immediately adjacent the mirror. Motions before the mirror, such as those caused by wind blowing leaves or branches, blend into the overall view pattern such that game are not spooked by the natural looking environment. Hunters may then experience the benefit of oncoming game for improved hunting success. Such stationary devices, however, have limitations that make their use limited, unworkable or undesirable. Such stationary devices are often too large or bulky to use to secretly approach a target or for general surveillance techniques. They are also awkward to pack, store, operate, and transport from place to place, and lack important features that assist or provide the user with a wide range of tactics and flexible options for efficiently adapting to the environment and overall surveillance.

Accordingly, there is a need and desire to overcome these and other limitations of the mirror technology. There is a further desire to present a lightweight portable mirrored surveillance shield that can be carried by a single user while secretly walking upon a target and simultaneously peering through the shield.

There is a further desire to present a surveillance shield having at least two mirrored panels detachably connected in a vertical relationship, and where the shield includes a handle for assisting in angling the shield to better reflect images.

Satisfaction of these needs and other items is made possible by the present invention which will become apparent in light of the present specification.

SUMMARY

The present invention is directed to surveillance shields, surveillance methods, methods for using surveillance shields, and methods of manufacturing surveillance shields. According to one aspect of the invention there is provided a surveillance shield having a substantially flat, substantially inflexible mirrored plastic panel, and at least one aperture defined by the panel, the aperture positioned in the panel such that a user may peer through the aperture while carrying the shield. The aperture may be positioned such that a user is substantially concealed by the shield while the user carries the shield and simultaneously peers through the shield.

According to another aspect of the invention there is provided a surveillance shield having a first substantially flat, substantially inflexible light-weight mirrored plastic panel component, a second substantially flat, substantially inflexible mirrored plastic panel component, at least one of the first and the second panel components defining at least one aperture, the first and the second panel components detachably connected in a vertical attitude.

According to a further aspect of the invention there is provided a surveillance shield having a first substantially flat, substantially inflexible mirrored plastic panel component, and a second substantially flat, substantially inflexible mirrored plastic panel component, the first component detachably connected to the second component, at least one of the first and the second components defining at least one aperture, the aperture positioned such that a user is substantially concealed by the shield while the user carries the shield and simultaneously peers through the aperture.

According to a further aspect of the invention there is provided a method of surveillance comprising, providing a substantially flat, substantially inflexible mirrored plastic shield having at least one aperture defined by the shield, and transporting the shield while peering through the aperture.

According to a further aspect of the invention there is provided a method of manufacturing a surveillance shield comprising, providing a substantially flat, substantially inflexible reflective or mirrored plastic panel, dividing the panel into first and second panel components, at least one of the panel components defining at least one aperture, and detachably engaging the first and second panel components in a vertical attitude. Each of the first and second panel components may have a grain running in a first general direction, and the panel components may be engaged while matching together their respective grains.

With these and other aspects in mind which will more readily appear as the nature of the invention is better understood, the invention comprises the novel combination and arrangement of features and steps hereinafter more fully described, illustrated and claimed with reference being made to the claims and drawings.

DETAILED DESCRIPTION

Figure 1:
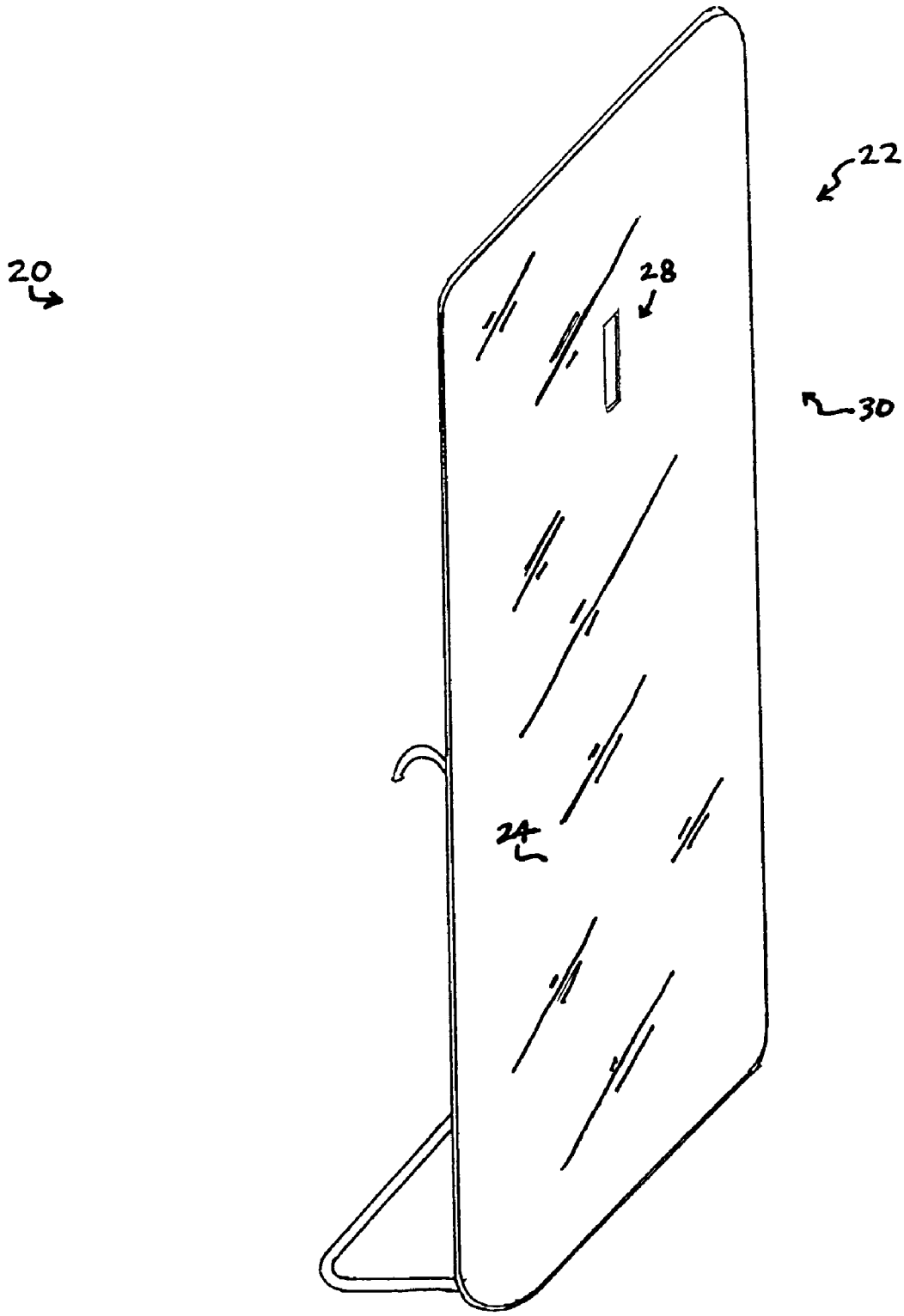
FIG. 1 is a perspective view of a surveillance shield according to one aspect of the invention.

Referring now to the Figures, a surveillance shield 20 includes a substantially flat, substantially rigid, reflectively mirrored plastic panel 22. Panel 22 is preferably of a variety having an outward or front side plastic material 24 treated with a back side layer 26 of an outwardly reflecting (i.e., through the front side plastic material 24) material. Front side material 24 is generally transparent and may include plastics such as acrylic (such as a plexiglass or Plexiglas® sheet) or other suitable material. Panel 22 may be vacuum metallized with aluminum or other suitable mirror producing material on its back surface 26. Other suitable methods for making mirrored plastic panel may be utilized. Back surface 26 preferably includes a tough opaque back-coat which protects the metallized surface. Panel 22 is advantageous in comparison with glass mirror and other reflecting materials in flexibility of design, installation and assembly. It is light weight, breakage resistant and can be used and fabricated more easily and safely than glass mirrors. Plastic panel 22 can be cut with conventional saws and routers, and can be drilled and machined to fit a desired shape.

Preferably panel 22 is a substantially flat, mirrored reflective and substantially optically correct outwardly facing panel adapted to reflect accurately the surrounding environment. Such optically correct panel 22 will allow for concealing the panel within the surrounding environment. Panel 22 is light weight and is of a size such that it may be carried by a single person while still concealing the person.

Figure 2:
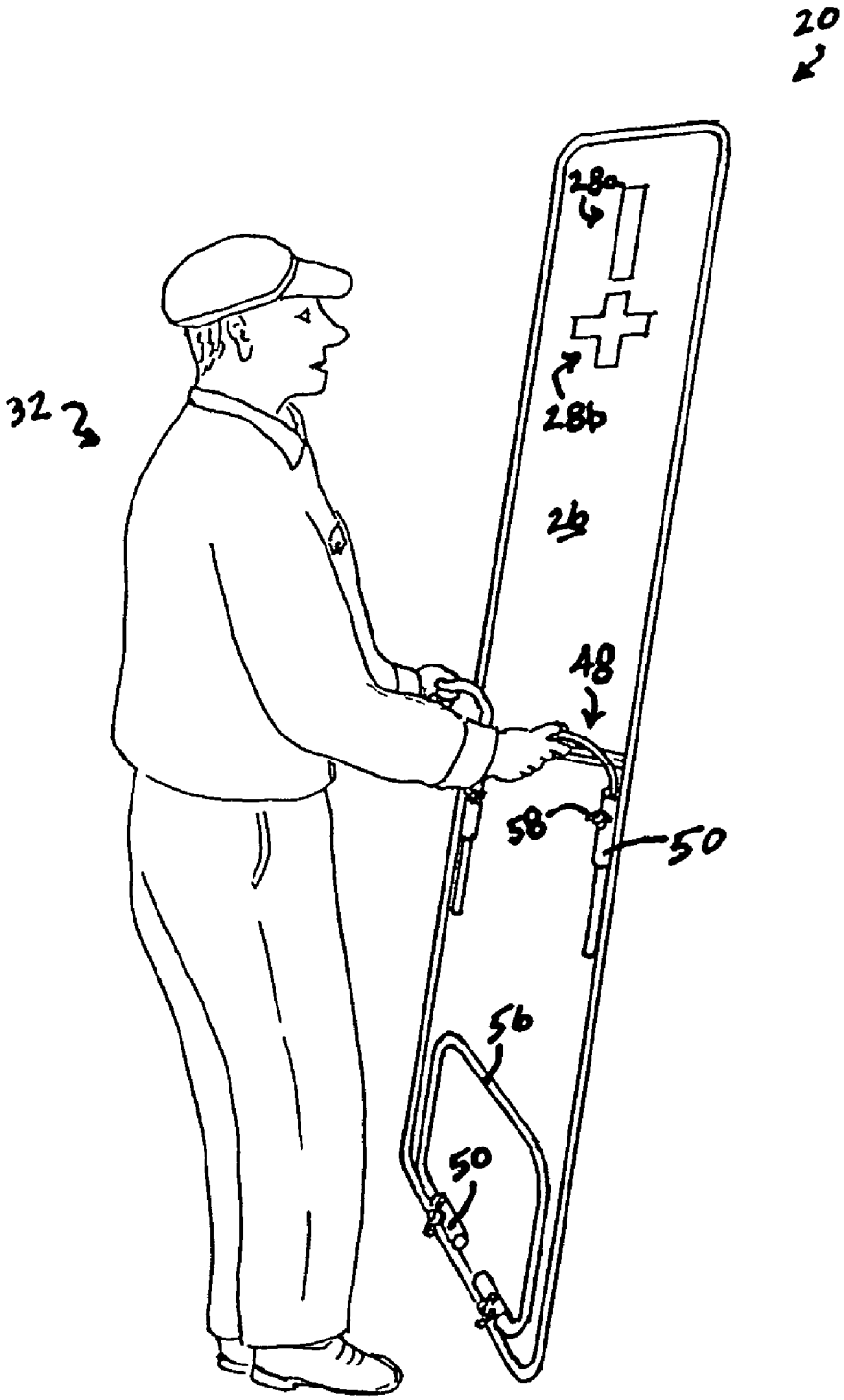
FIG. 2 is a perspective view of a further aspect of the present invention.
Figure 5:
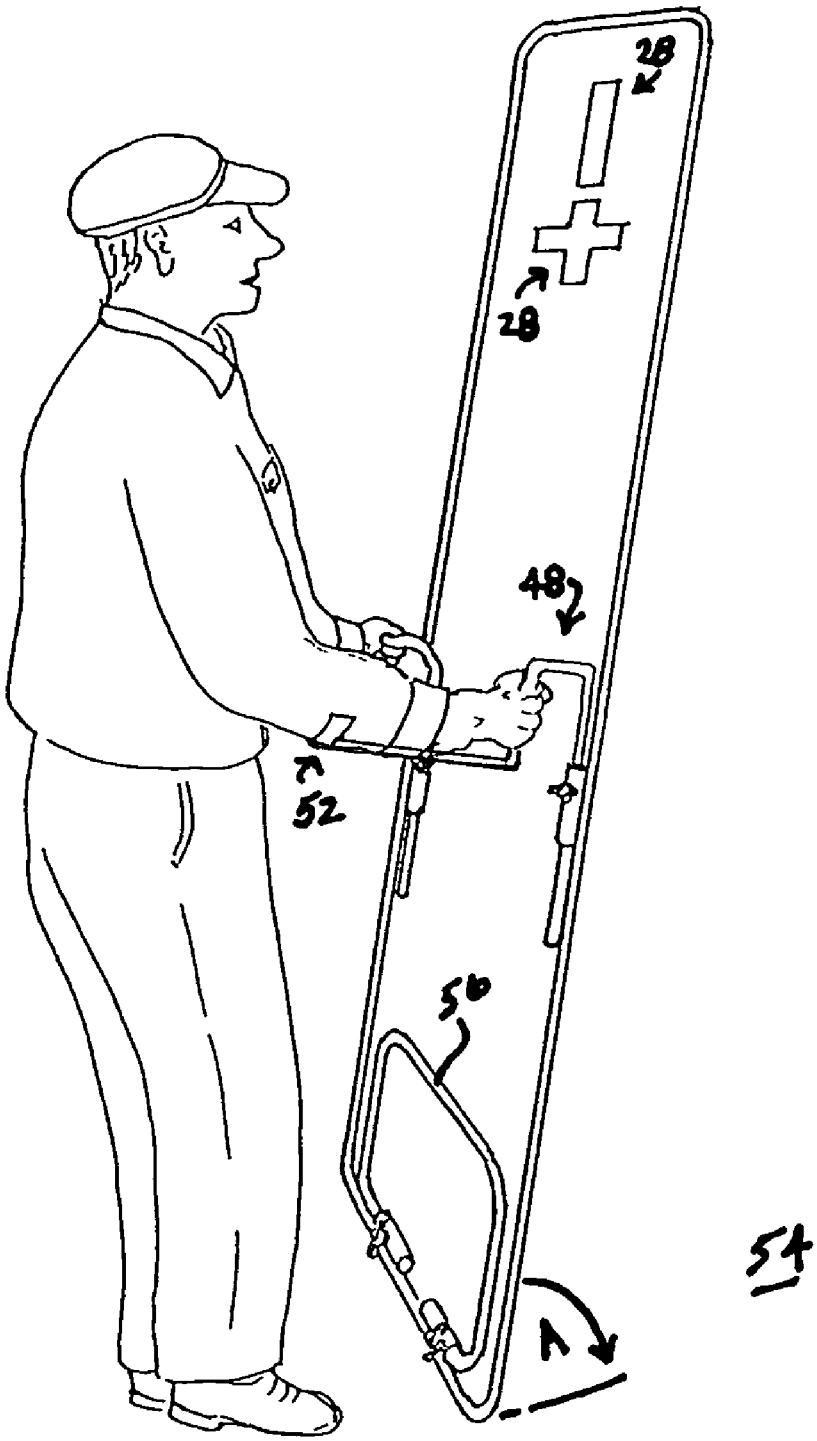
FIG. 5 is a perspective view of a further aspect of the present invention.

Panel 22 includes an aperture 28 such that a person carrying shield 20 may peer through the aperture 28 while carrying the shield 20. Preferably shield 20 has a generally rectangular configuration with a height dimension "h" greater than a width dimension "w". One suitable configuration includes shield 20 having a height h of about 5 to 6½ feet, and preferably about 6 feet, and a width w of about 2 to 3½ feet, and preferably about 2½ feet. Preferably aperture 28 is positioned toward an upper portion 30 of the shield 20 to allow a user 32 to peer through the aperture 28 while standing or carrying the shield 20 in an upright manner as shown in FIG. 2 and FIG. 5.

Aperture 28 is preferable vertically oriented such that user 32 may vertically scan the upcoming terrain so as to walk without tripping or otherwise tactically maneuver the shield 20. Aperture 28 may include apertures of different configurations, which are not limited to those as shown in the drawings. Aperture 28 may include a physical hole or opening of desired configuration. Aperture 28 may also include an area in panel 22 which is void or generally lacking of metallized aluminum or other mirror producing material or layer. In such case the back surface 26 would lack an opaque back-coat over the area such that aperture 28 includes the transparent acrylic area to allow a user to peer through panel 22 despite not having a physical, as opposed to visual, opening. Preferably a second aperture 28*b* is provided vertically adjacent aperture 28*a* so that user 32 may opt to peer through either aperture 28*a* or 28*b* as desired. The lower aperture, designated as 28*b* as shown in FIG. 2 is preferably horizontally oriented to allow for horizontal scanning of the environment and more preferably, such as in a case where aperture is a physical opening in panel 22, for placement of a camera or firearm to thereby follow motion of a target. Aperture 28*b* may have an elongated shape or other configuration depending upon preference or depending upon the particular surveillance operation. In combination, apertures 28*a* and 28*b* provide user 32 with convenient sighting ability together with convenient camera/firearm positioning while effectively concealed from view behind shield 20. It may be appreciated that the smaller the size of apertures 28*a*, 28*b*, the greater the mirrored area of panel 22. Too large an aperture 28*a*, 28*b* would increase the opportunity for user 32 being detected. Use of vertically aligned aperture 28 such as shown in FIG. 1 provides a smaller profile yet effective arrangement for mobilization.

Shield 20 preferably includes a frame 34. Frame 34 is preferably positioned opposite the reflective side 24 of panel 22. Frame 34 includes at least one frame member 36, and preferably frame members 36*a*, 36*b*, 36*c*, and 36*d* which generally bound the perimeter of panel 22. Preferably frame member 36 is secured to an edge portion 40 of panel 22, where edge portion 40 is located within the perimeter of the panel 22, and at least a portion of frame member 36 is preferably off-set from panel edge 42. The off-set 44 is preferably about ¼" from edge 42. Such off-set position lessens the possibility that the frame member 36 will be visible from the front side 24 or from a side angle position. Frame member 36 is preferably made of aluminum and is secured to panel 22 by suitable fasteners 38, including but not limited to rivets, bolts or screws. Frame members 36 are preferably made from hollow section aluminum tubing (square or round or otherwise) and may be configured to align the edge portion of most any type of shaped panel 20.

Figure 4:
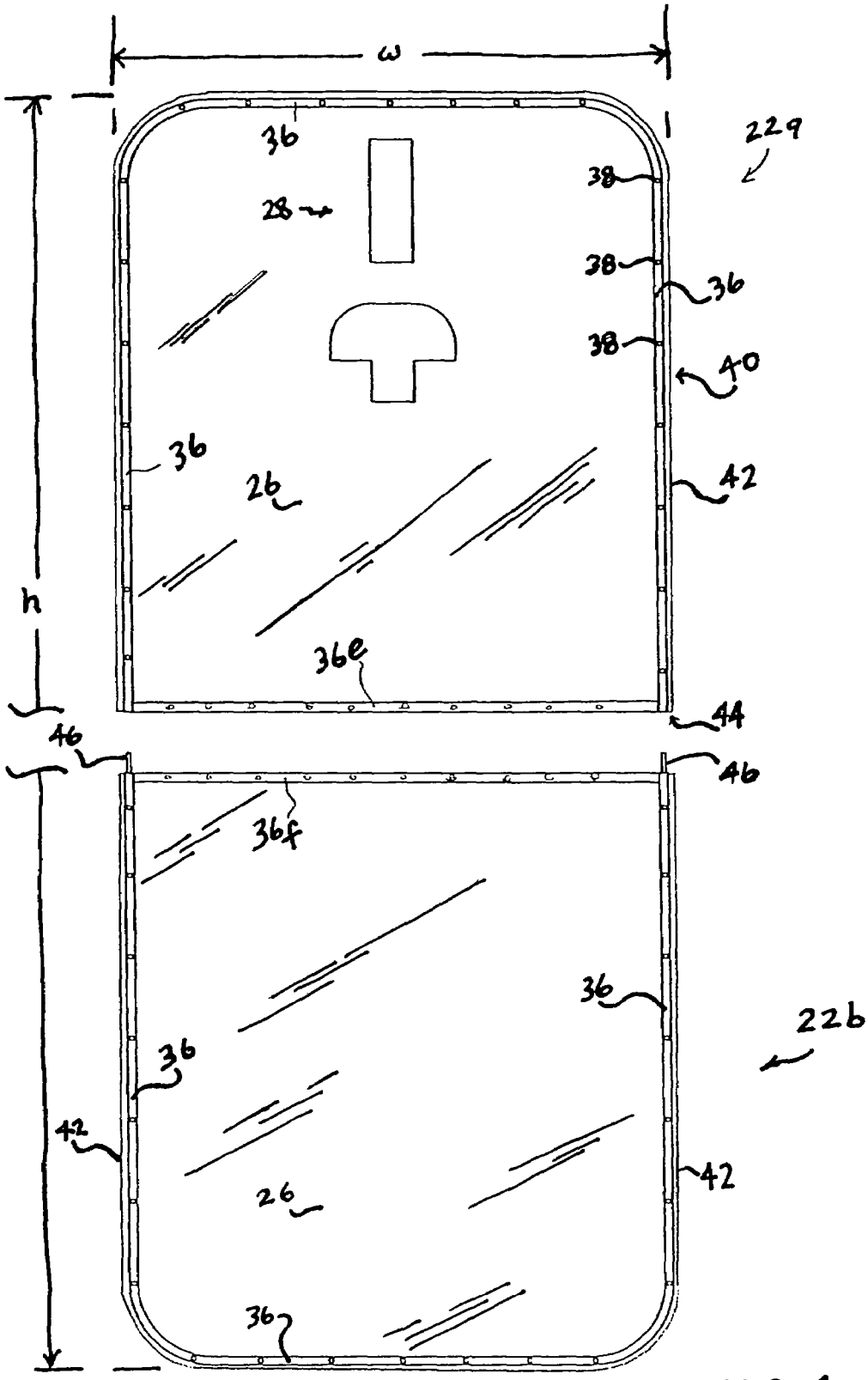
FIG. 4 is an exploded back view of a further aspect of the present invention.

While shield 20 may preferably include a single panel 22 as shown in FIG. 1, it may be appreciated that shield 20 may be made of two or more panels 22, preferably two panels 22*a* and 22*b* as shown in FIG. 4. Panels 22*a* and 22*b* are preferably made from the same sheet of mirrored plastic so as to maintain equivalent or nearly identical reflective properties. Preferably panels 22*a* and 22*b* are detachably connected in a vertical arrangement or attitude, with panel 22*a* positioned above panel 22*b*. Panels 22*a* and 22*b* may be connected with any number of connectors, including but not limited to having plugs 46 which extend from frame member 36 of panel 22*b* into frame member 36 of panel 22*a*. As shown in FIG. 4, frame member 36*e* and frame member 36*f* are not off-set from an edge of panel 22 to allow for a more secure mating and to lessen optical distortion between the two panels 22 along their common connection. While distortion may occur with multiple-panel arrangements, the distortion is unlikely or less likely to be problematic for use in surveillance of wild game and the like. A lower cost may therefore be realized with multiple panels as opposed to a single panel arrangement which is preferably provided in the case of law enforcement surveillance where even minor distortions may be unacceptable. It may be appreciated that different or additional clamps or clips may be used to engage panels 22. Preferably panel 22*a* contains aperture 28, while panel 22*b* is a surface without apertures. It may be appreciated that aperture 28 may be positioned in a variety of locations, but preferably is positioned such that a user is substantially concealed by the shield 20 while the user transports, holds, or carries the shield 20 and simultaneously peers though the aperture 28. In addition to the foregoing, aperture 28 may be positioned near or at an edge portion of panel 22 or even situated between adjacent panels 22*a* and 22*b*.

Shield 20 is preferably made of a single panel 22 having any number of selected dimensions of height "h" and width "w", with common dimension of 6 feet, 5 feet or 4 feet tall by 32 inches wide. Separate panels 22 may be connected together to create a desired size. A single panel is preferred over multiple panels in order to reduce distortion or reflected images which otherwise tends to occur at the region where panels are joined. An optional skirt (not show) may be attached to the lower portion of shield 20 to better conceal the feet or legs of a user who uses a shorter sized shield. The skirt may hang downward from the shield 20 while the user walks behind the shield 20.

In the manufacture of a multiple panel shield 20, preferably each panel 22 is cut from the same stock having a grain running in a general first direction. After the panels are divided from the stock, they are preferably affixed with fame members 36 and pieced back together and into their original relationship, all preferably having grain running in the first direction so as to lessen distortion of a reflected image.

Having multiple panels 22 allows for ease in storage and transport. A single user may place panels 22 in a case or protected pouch having a shoulder strap and transport the same in the trunk or storage area of a vehicle. The pouch may be easily removed and carried, and the panels 22 may be assembled once the user is closer to the intended target area. Multiple panels 22 can be provided so a user may assemble as many panels 22 as needed for any particular operation, or so that multiple users may simultaneously use shield 20.

While panel 22 may also include an additional aperture 28 to use as a hand hole for carrying the shield 20, shield 20 preferably includes at least one handle 48, and preferably two handles, preferably attached to frame member 36. Handle 48 may also attach to a holder 50 which receives handle 48 and allows for desired adjustment, rotation, or removal. Adjustable fasteners, including but not limited to wing nut 58, may be used to adjust handles 48. Handle 48 and holder 50 may include a variety of holes for selective adjustment of the positioning of handle 48 to accommodate the comfort and effectiveness of using shield 20.

As shown in FIG. 5, handle 48 preferably includes forearm support 52 to accommodate ease of use. Preferably handle 48 is configured such that a user may conveniently adjust the pitch of shield 20 so as to visually blend into the immediate environment. Holding or carrying shield 20 at an angle to downwardly reflect images of the surrounding environment is preferred over holding at an angle to reflect the sky or other image that does not blend into the environment. Therefore, handle 48 is preferably configured with a natural bend to accommodate a preferred or proper pitch. A proper pitch is at an angle represented generally by the arrow A, and is an angle between about 90 to 45 degrees, and preferably between about 85 to 70 degrees. By holding shield 20 in a forward-leaning attitude, an onlooker looking or scanning in the general direction of shield 20 would view the reflection of the surrounding ground 54 or environment. User 32 may therefore stand or walk behind shield 20 while holding or carrying shield 20 at an angle to thereby conceal himself and approach a target while being undetected. It may be appreciated that user 32 may also crouch down or crawl while aligning shield 20 in a generally horizontal position. With shield 20 aligned in a generally horizontal position (not shown) a user may lie on the ground and peer through aperture 28, and aperture 28 may also be formed of a shape to fit the desired use.

Figure 7:
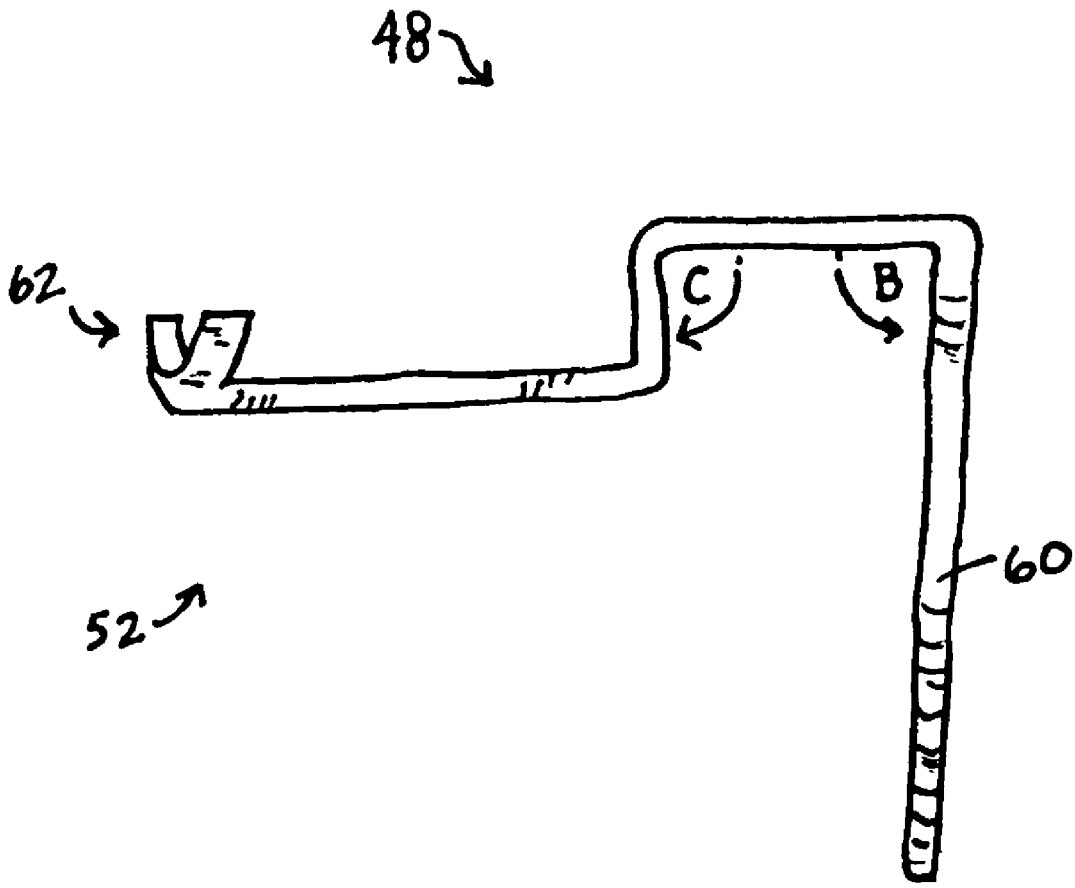
FIG. 7 is a perspective view of a handle aspect of the present invention.

As shown in FIG. 7, handle 48 may include forearm support 52 to ease the holding of shield 20. Handle 48 may be angled as shown generally by the arrows represented at arrow B and/or at arrow C. Preferably angles B and/or C are at right angles or less than right angles to accommodate a desired pitch for handle insert member 60. It may be appreciated that handle 48 may include adjustment points (not shown) to accommodate most any variety of configuration. Cup 62 may cradle a user's forearm and may pivot if desired. Handle insert member 60 may insert into holder 50 and rotate and contain adjustment points (not shown) to accommodate comfort. Other configurations of handle 48 may be used with equal or improved results and handle is not meant to be confined to include only those features as shown or described.

Figure 3:
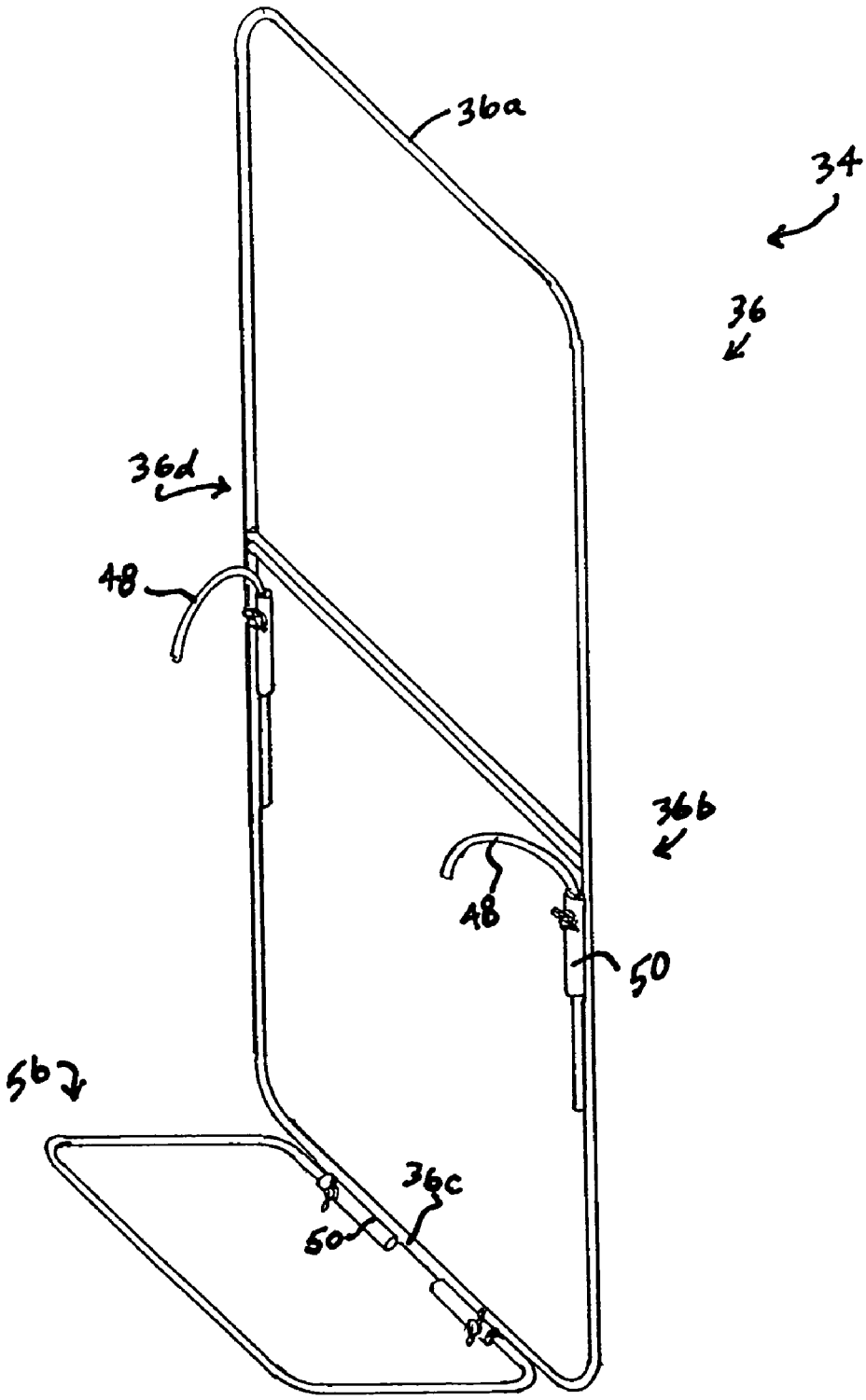
FIG. 3 is a perspective view of a component of the invention.
Figure 6:
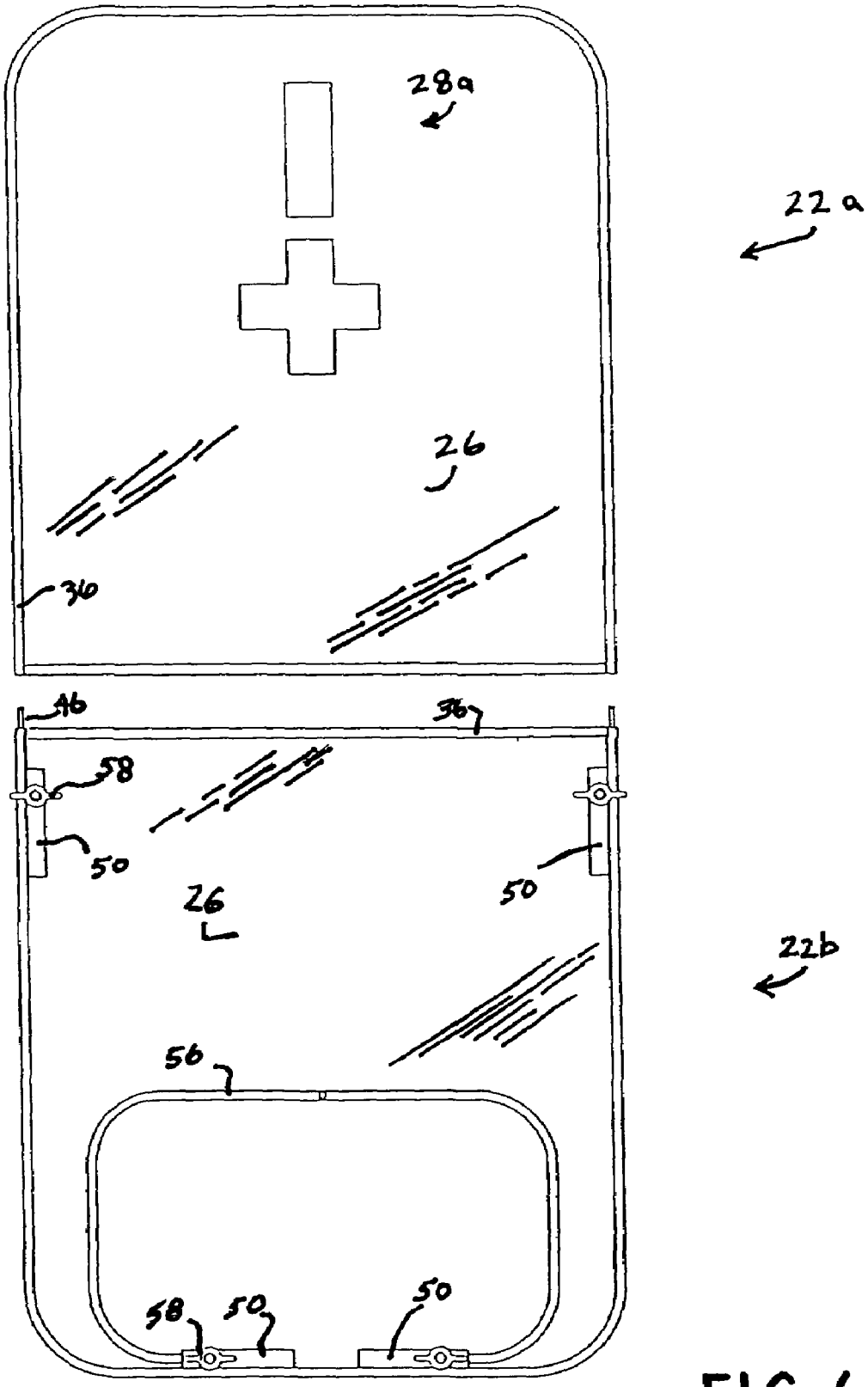
FIG. 6 is an exploded back view of a component of the present invention.

Shield 20 may further include a foot stand 56 detachably connected to frame 36. Preferably stand 56 rotates from a storage or walking position as shown in FIG. 2 or FIG. 5 to a standing position as shown in FIG. 1 and FIG. 3. User 32 may use his foot or hand to retract foot stand 56 while maintaining shield in an angle position. Once stand 56 is retracted, user 32 will then enjoy free use of his hands to use a camera or firearm as desired, or to simply enjoy the surroundings while being concealed. User 32 may stand on foot stand 56. Foot stand 56 may be inserted into holder 50 and equipped with fasteners to securely lock stand 56 into a set position so that shield 20 may self-stand. Foot stand 56 may also be extended when shield 20 is placed on ground 54 in a generally horizontal position to support shield so that user 20 may lay on the ground 54 while undertaking surveillance. FIG. 6 shows an exploded back view of one aspect of the present invention where holders 50 may include adjustments such as wing nuts or other mechanisms to accommodate for desired use. A user may conveniently attach and/or separate panel 22*a* from panel 22*b* for convenient storage or transport.

Frame members 36 may further include snaps (not shown) or other fasteners to accommodate the securing of a cloth for positioning over-head user 32 for further concealment. Other accessories may include use of magnets or metal strips glued adjacent apertures 28 to receive a mirrored cover to conceal the aperture.

In operation a user may undertake surveillance by providing the shield 20 and transporting the shield 20 while peering through the aperture 28. Transporting the shield 20 in such surveillance method includes, but is not limited to, preferably carrying the shield 20. Preferably the surveillance includes providing shield 20 having a substantially optically correct mirrored surface to reflect the surrounding environment, and to also provide shield 20 of a size to substantially conceal the user while the user transports and peers through the shield 20. Different sized shields 20 may be configured depending on the desired surveillance undertakings. Applicant believes a surprising benefit of the invention is that law enforcement officials will be able to conveniently use the shield 20 to approach suspected improper activities, such as is common in areas of methamphetamine manufacture at labs in remote areas, or for other homeland security operations.

This written description uses illustrative embodiments to disclose the invention, including the best mode, and also to enable a person of ordinary skill in the art to make and use the invention. Other embodiments are within the scope of the claims if they have elements that do not differ from the literal language of the claims, or have equivalent elements.

What is claimed is:

1. A surveillance shield comprising:

a substantially flat, substantially inflexible mirrored plastic panel having a perimeter;

at least one aperture formed completely within said panel, said panel being a single piece of mirrored plastic;

an elongated frame member connected to the panel at a position completely within said perimeter; and where said panel is mirrored on a first side of said panel, said frame located on a second side of said panel opposite said first side.

2. The shield of claim 1 where said shield includes at least one handle secured to said frame member at a position within said perimeter, said handle projecting from said frame member and extending from said second side of said panel, said handle having a forearm engaging portion.

3. The shield of claim 1 further including a handle connected to said shield at a position completely within said perimeter and projecting from said second side of said panel.

4. The shield of claim 1 wherein said panel defines at least a second aperture formed within said panel, wherein said at least second aperture comprises a hand hole for carrying said shield while simultaneously allowing a user to peer through said at least one aperture while carrying said shield.

5. The shield of claim 1 wherein said panel defines at least a second aperture, wherein said at least second aperture is positioned above said at least one aperture wherein a user may peer through said second aperture while said shield is in a placed position.

6. The shield of claim 1 wherein said at least one aperture is generally a vertical slot configured for a user to scan the environment while transporting said shield in a generally concealed fashion.

7. The shield of claim 1 wherein said shield further comprises a second mirrored plastic panel detachably connected to said mirrored plastic panel.

8. The shield of claim 1 wherein said aperture is positioned such that a user is substantially concealed by said shield while the user transports said shield and simultaneously peers through said shield.

9. The shield of claim 8 wherein said aperture is positioned such that a user may peer through said aperture while carrying said shield in an upright walking manner.

10. The shield of claim 1 where said mirrored first side of plastic panel is a substantially optically correct outward facing surface to reflect accurately the surrounding environment and thereby substantially conceal the appearance of said shield, and wherein said aperture comprises an area in said panel generally lacking a mirror producing material.

11. The shield of claim 10 wherein said aperture is an opening in said panel and allows an article to be placed therethrough.

12. The shield of claim 1 where said shield includes a second mirrored plastic panel having a second perimeter and is mirrored on a first side of said second plastic panel, said second plastic panel having a second elongated frame member connected at an edge portion of said second panel, said edge portion of said second plastic panel located completely within said second perimeter, said panels detachably connected to each other, each of said mirrored first sides of said panels is a substantially optically correct outward facing surface to reflect accurately the surrounding environment and thereby substantially conceal the appearance of said shield, and where said second elongated frame is located on a side of said second plastic panel opposite said mirrored first side of said plastic panel.

13. The shield of claim 12 where said shield includes at least one handle secured to at least one of said frame member, said handle projecting from said at least one of said frame members and extending from said side of said panel opposite a mirrored side of said panel, said handle being located completely within said perimeters of said panels.

14. The shield of claim 13 wherein said handle includes a forearm engaging portion.

15. The shield of claim 1 wherein said shield includes a handle for holding said shield in a forward-leaning attitude.

16. The shield of claim 1 where at least a portion of said frame member is off-set from said perimeter of said panel.

17. The shield of claim 1 wherein said shield includes a foot stand.

18. A method of surveillance comprising transporting and simultaneously peering through said shield of claim 1.

19. The method of claim 18 further comprising walking behind said shield while peering through said aperture while substantially concealed by said panel.

20. A portable surveillance shield comprising:

a first substantially flat, substantially inflexible reflective plastic panel;

at least a second substantially flat, substantially inflexible reflective plastic panel, at least one of said first and said second panels defining at least one aperture;

said first and said second panel detachably connected and each said first and second panel having a perimeter;

said first plastic panel having a first elongated frame member and said second plastic panel having a second frame member; and said first and second frame members located completely within said perimeters.

21. A surveillance shield comprising:

a first substantially flat, substantially inflexible reflective plastic panel; and at least a second substantially flat, substantially inflexible reflective plastic panel, said first panel detachably connected to said second panel, at least one of said first and said second panels defining at least one aperture, said aperture positioned such that a user is substantially concealed by said shield while the user carries said shield and simultaneously peers through said shield;

said first and second panels having a perimeter;

said first plastic panel having a first elongated frame member and said second plastic panel having a second frame member; and said first and second frame members located completely within said perimeters.

22. The shield of claim 21 wherein said first and said second panels are mirrored plastic panel components and aligned vertically and substantially in the same plane.

23. A method of surveillance comprising:

providing a substantially flat, substantially inflexible mirrored plastic shield having at least one aperture defined by said shield; and transporting said shield while peering through said aperture.

24. The method of claim 23 wherein said shield includes a substantially optically correct outward facing surface to reflect the surrounding environment and wherein the user is substantially concealed by said shield while the user carries and peers through said shield.

25. A method of manufacturing a surveillance shield comprising:

providing a substantially flat, substantially inflexible mirrored plastic first panel and a substantially flat, substantially inflexible mirrored plastic second panel;

at least one of said first and second panels defining at least one aperture;

attaching a first elongated frame to said first panel and a second frame to said second panel, said first elongated frame located completely within a perimeter of said first panel and said second frame located completely within a perimeter of said second panel; and detachably engaging said first and second panels.

26. A surveillance shield comprising:

a substantially flat, substantially inflexible mirrored plastic panel;

at least one aperture defined at least in part by said panel;

a frame member connected at an edge portion of said panel;

at least one handle secured to said frame member, said panel mirrored on a first side of said panel, said frame located on a second side of said panel opposite said first side;

said handle projecting from said frame member and extending from said side of said panel opposite said mirrored side of said panel, and said handle including a forearm engaging portion.

27. The method of claim 23 where said transporting further comprises transporting said shield while holding a handle of said shield to automatically tilt said shield in a tilt-forward position while transporting.

* * * * *